US008430335B2

(12) United States Patent
Bosterling et al.

(10) Patent No.: US 8,430,335 B2
(45) Date of Patent: Apr. 30, 2013

(54) ELASTIC TENSIONING CLAMP AND RAIL FIXATION THEREFORE

(75) Inventors: Winfried Bosterling, Neuenrade (DE); Farhad Esfandiyari, Iserlohn (DE); Michael Steidl, Chicago, IL (US)

(73) Assignee: Vossloh Werke GmbH, Werdohl (DE)

( * ) Notice: Subject to any disclaimer, the term of this patent is extended or adjusted under 35 U.S.C. 154(b) by 14 days.

(21) Appl. No.: 13/139,750

(22) PCT Filed: Sep. 2, 2009

(86) PCT No.: PCT/EP2009/061331

§ 371 (c)(1),
(2), (4) Date: Sep. 1, 2011

(87) PCT Pub. No.: WO2010/076047

PCT Pub. Date: Jul. 8, 2010

(65) Prior Publication Data

US 2011/0315784 A1 Dec. 29, 2011

(30) Foreign Application Priority Data

Dec. 29, 2008 (EP) ..... 08172979

(51) Int. Cl.
*E01B 9/00* (2006.01)

(52) U.S. Cl.
USPC ..... 238/349; 238/351

(58) Field of Classification Search ..... 238/349, 238/351, 352–354, 315, 343–345
See application file for complete search history.

(56) References Cited

U.S. PATENT DOCUMENTS

| | | | | |
|---|---|---|---|---|
| 4,632,307 | A * | 12/1986 | Weber | 238/265 |
| 5,096,119 | A * | 3/1992 | Schultheiss et al. | 238/349 |
| 2008/0237363 | A1* | 10/2008 | Hauschild et al. | 238/349 |
| 2009/0302126 | A1* | 12/2009 | Wirthwein et al. | 238/349 |
| 2011/0315784 | A1* | 12/2011 | Bosterling et al. | 238/349 |
| 2012/0111959 | A1* | 5/2012 | Krieg | 238/349 |
| 2012/0111960 | A1* | 5/2012 | Bosterling | 238/349 |

FOREIGN PATENT DOCUMENTS

| | | |
|---|---|---|
| DE | 3334119 | 4/1985 |
| DE | 102004033723 | 2/2006 |
| EP | 1116827 | 7/2001 |
| EP | 1693514 | 8/2006 |

OTHER PUBLICATIONS

International Search Report dated Nov. 9, 2009 with respect to international application No. PCT/EP 2009/061331.
Written Opinion of the International Searching Authority dated Nov. 9, 2009 with respect to international application No. PCT/EP 2009/061331.

* cited by examiner

*Primary Examiner* — Jason C Smith
(74) *Attorney, Agent, or Firm* — Scott R. Cox

(57) ABSTRACT

An elastic tensioning clamp made of spring steel for rail fixation comprises a central loop (44) having two inner legs (46) connected by an arc-shaped central portion (48) as well as nooses (42) connected to the inner legs (46) of the central loop (44) and running towards the free ends (50) of the tensioning clamp (40). The nooses (42) are formed so as to have, in the unloaded state, a maximum height (H) of at least 20 mm above the upper plane ($E_2$) of the central loop (44) in the region of the two inner legs (46).

14 Claims, 5 Drawing Sheets

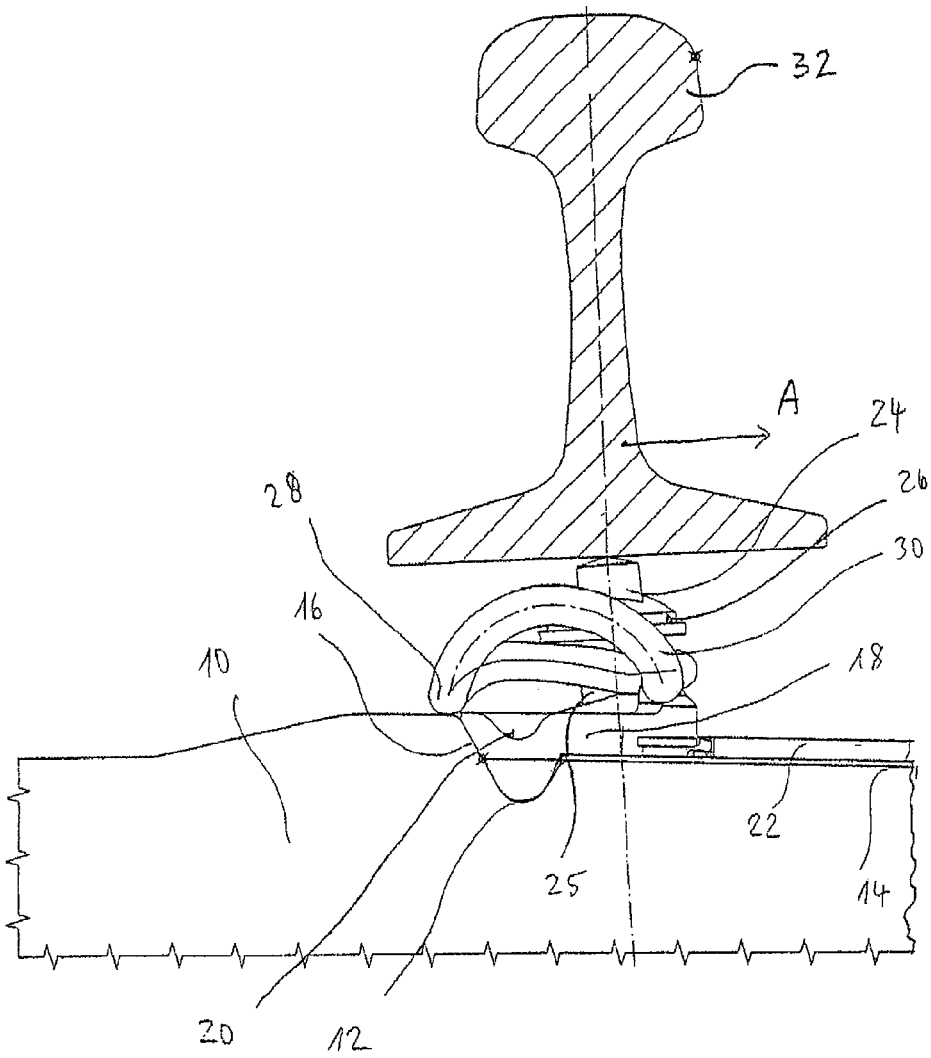
Fig. 6 State of the Art

ELASTIC TENSIONING CLAMP AND RAIL FIXATION THEREFORE

FIELD OF THE INVENTION

The invention concerns an elastic tensioning clamp according to the preamble of patent claim 1 as well as a rail fixation arrangement comprising such a tensioning clamp.

Tensioning clamps for rail fixation have been known for a long time and have proved their worth in comprehensive use. The elastic tensioning clamps are pressed onto the foot of the rail by means of screws to be anchored in the sleepers, as is for example described in DE 32 43 895 A1. The tensioning clamp described therein may be already pre-assembled (pre-mounted) in the sleeper factory and may be rotated from its pre-assembled position by 180° into the assembled position for definitive tensioning (clamping) of the rail in the track. The tensioning clamp comprises an arc-shaped central portion as well as two legs connected to the central portion. In their assembled position, the arc-shaped central portion and the legs connected thereto surround the shaft of a sleeper screw for fixation on a sleeper. The elastic fixation of the rail is effected by means of tensioning clamp sections connected to the inner legs, which press onto the foot of a rail. In addition to the elastic tensioning clamp, the rail fixation arrangement comprises a guide plate which rests on the sleeper on each side of the rail foot and the surface contour of which is adapted to the elastic tensioning clamp so that the forces coming from the rail can be guided into the sleeper.

Due to an increasing automisation in track construction within the framework of the pre-assembly a further rail fixation has been developed which no longer needs to be rotated from its pre-assembled position into the assembled position but can be displaced horizontally and perpendicular to the rail. Such a tensioning clamp is described in DE 33 34 119 C2. Also this tensioning clamp cooperates with a guide plate specially adapted to the tensioning clamp in order to guide the arising forces into the sleeper.

From EP 1 246 970 B1 an elastic tensioning clamp has become known, that is configured so as to avoid a concatenation of a plurality of constructionally identical tensioning clamps in a storage container. Also this measure serves the purpose to allow an increasing automisation of track construction during pre-assembly in the sleeper factory.

In track installation at sleepers having pre-assembled rail fixation arrangements problems do occur, however. Often, the heavy rails are not sufficiently raised before they are lowered into the rail channel between two rail fixation arrangements.

To that end, FIG. 6 illustrates an example from the state of the art. There are shown a sleeper 10, the rail channel 14 next to a pre-assembled rail fixation arrangement as well as a tensioning clamp 30 resting upon an angle guide plate and being pre-mounted on the sleeper in the unloaded state by means of a sleeper screw 24, wherein the head 26 of the sleeper screw 24 bears upon the tensioning clamp 30.

Now if the rail 32 is not raised sufficiently far during rail assembly, the rail 32 will come to bear upon the head 26 of the sleeper screw 24, as is shown in FIG. 6. If the rail is then moved further in the direction of the rail channel 14 indicated by arrow A, the sleeper screws 24 are "pulled along" due to the high weight of the rails and are bent by them. In other words, with a high bearing weight of the rail on the head of the sleeper screw, the frictional force generated thereby may become so large that the head of the sleeper screw can no longer slip through under the rail foot but is bent in the movement direction A. The result of this is that in subsequent assembly of the rail fixation arrangement, the bent sleeper screws have to be unscrewed and substituted by new screws, which is time consuming and cost intensive, but most of all creates substantial problems within the framework of an automated rail assembly. Existing rail laying machines are often not configured to sufficiently raise the rail in order to securely avoid a bearing of the rail on the sleeper screw.

SUMMARY OF THE INVENTION

It is an object of the invention to provide an elastic tensioning clamp as well as a rail fixation arrangement utilising such a tensioning clamp, which have improved properties with respect to the assembly effort.

This object is achieved by means of an elastic tensioning clamp for rail fixation having the features of claim 1. The rail fixation arrangement comprising a tensioning clamp according to the invention is defined by the features of claim 10. Preferred embodiments are defined in the remaining claims.

The elastic tensioning clamp for rail fixation according to the invention is made of spring steel and comprises a central loop having two inner legs connected by an arc-shaped central portion as well as nooses (lugs) connected to the inner legs of the central loop and running towards the free end of the tensioning clamp. The nooses of the elastic tensioning clamp are shaped so as to have a maximum height of at least 20 mm each in the unloaded state and preferably about 24 mm above the upper plane of the central loop in the region of the two inner legs. The upper plane of the central loop is defined as running through the upward-facing surfaces of the inner legs on which the screw head of a sleeper screw rests. The upper plane of the central loop thus bears upon the inner legs of the tensioning clamp, just as the head of a sleeper screw.

The invention is based upon the notion to configure the nooses of the elastic tensioning clamp connected to the two inner legs of the central loop such that they extend in the unloaded state by at least a height H of 20 mm above the upper plane of the central loop defined above, which corresponds, in the pre-assembled state, to a height H of about 7 to 8 mm more than in the unloaded state because, in the pre-assembled state, the sleeper screw elastically presses down the central loop by about this measure. Thus, in the pre-assembled state, the height of the nooses is situated far above the bearing surface of the screw head of a sleeper screw above the inner legs that the pre-assembled head of a sleeper screw is protected already in the pre-assembled state, since a possible bearing of the rail on the pre-assembled tensioning clamp now no longer occurs in the region of the sleeper screw but in the region of the nooses of the tensioning clamp.

By dimensioning the outer curvature of the nooses so that they extend slightly over the vertical extension of the head of the sleeper screw, a bending of the sleeper screw can be avoided. At the same time, the nooses of the tensioning clamp are configured such that they do not have any step-shaped transitions and may serve as a type of ramp in order to be able to guide the rail over the ramp in the direction of the rail channel. The head of a sleeper screw is not exactly defined as far as its dimensions are concerned. In order to ensure the functionality in the course of assembly, however, certain minimum dimensions for the head of a sleeper screw have to be observed. Thus, it is not expedient to provide the head of the sleeper screw with a height of less than 30 mm, to be followed by the inventive dimensions of the nooses with respect to the inner legs.

As existing rail-laying machines often are not configured to be able to sufficiently raise the rail, it is preferred that the maximum height of the nooses above the upper plane of the central loop in the region of the two inner legs does not exceed about 42 mm. To large a maximum height would be disadvantageous as existing rail-laying machines that cannot raise the rail sufficiently, in general would have to push the rails over the ramps formed by the tensioning clamps in the direction of the rail channel. Therefore, a maximum height above the upper plane of the central loop is advantageous in order to keep the necessary lifting work low while at the same time guaranteeing the desired protection of a sleeper screw having an often used height of the head of about 40 mm.

According to preferred embodiment, the inner legs run substantially parallel to each other. This allows to displace the elastic tensioning clamp both horizontally perpendicular to the rail from its pre-assembled position into the assembled position and to use the tensioning clamp as a substitute for tensioning clamps that need to be rotated from their pre-assembled position into the assembled position by 180° for definitive tensioning of the rail in the track. Finally, the automatic pre-assembly is facilitated by the parallel guiding action of the inner legs without a constriction of the central loop.

It is preferred to provide the inner legs at the upper side in the assembled position with a bevel (flat portion) in the bearing region of a sleeper screw that fastens the tensioning clamp in a mounting position. Such bevels allow the head of a sleeper screw to bear possibly on the entire surface on the inner legs and thus avoid undesired deformations of the screw head at positions having to a high local pressing (stress).

In order to optimally transfer, after fixation of the sleeper screw, the forces acting upon the central loop onto the rail foot to be fastened, it has turned out to be advantageous to connect the nooses by means of a rear support arc to the inner legs, wherein the nooses are shaped so as to have an arc-shaped course in the assembled position both in a horizontal direction and in a vertical direction. This arc-shaped course in two directions allows a good transfer of the desired bending and torsional moments in the direction toward the free ends of the tensioning clamp resting upon the rail foot.

According to a particularly preferred embodiment, the tensioning clamp has an endurance limit of more than 3 million load alternations (load reversals), preferably more than 5 million load alternations, at a tensioning force, i.e. holding-down force of between 10 kN and 15 kN and preferably at about 12.5 kN. By this means, not only the assembly effort but also the maintenance effort of the rail fixation arrangement is minimised. The high preferred endurance limit at normal tensioning of the tensioning clamp and at an amplitude (oscillation width) of at least 2.2 kN contribute to a de facto unlimited endurance limit of the tensioning clamp as the most stressed component of a rail fixation arrangement. The endurance limit, that is the oscillation width of the tensioning clamp, is at least 2.2 mm and thus meets exacting demands in terms of a secure rail fixation.

Preferably, the tensioning clamp is configured so that the rear support arc is formed so that the distance D between the inner leg and the tangential plane on the noose running parallel thereto is $D \geqq 50$ mm and preferably $D \geqq 60$ mm. The inner legs and the nooses in the region of the furthest extension away from the inner leg in a horizontal direction do not lie in a horizontal plane. Thus, the distance between the inner leg and the tangential plane running parallel thereto is defined because it is the relevant distance for the torsion path. Providing a high torsion path is advantageous because the torsion path cooperates with the spring stiffness of the material in order to provide the desired characteristic of the rail fixation. However, apart from the distance D and the spring stiffness of the tensioning clamp the geometry of the noose itself is co-decisive, too. Thus, it is particularly preferred that the nooses of the tensioning clamp describe an arc in top view, the secants S of which are substantially parallel to the extension of the inner legs.

Further, it is preferred that free distance between the arc-shaped central portion of the central loop and the free ends of the tensioning clamp is smaller than the diameter of the spring steel in the region of the free end of the tensioning clamp. By this means, a simple pre-assembly of the tensioning clamps is rendered possible because a concatenation of the tensioning clamps in a storage container is counteracted. Thus, during pre-assembly an automatic withdrawal of single tensioning clamps from a storage container can be performed. Even in manual pre-assembly, the withdrawal of individual tensioning clamps provides the advantage that no possibly formed concatenations of tensioning clamps have to be disengaged from each other. However, merely by the definition of the distance between the free ends and the arc-shaped central portion of the central loop the danger of a concatenation of several tensioning clamps can not yet be excluded as a catching of two tensioning clamps may occur at any location because the constriction between the nooses and the central portion may also be arranged at a distance from the free end and, moreover, the complicated sequence of motions in a possible catching of identically constructed tensioning clamps has to be considered. However, the danger of a catching is substantially reduced by the above mentioned means. A sproradically occurring wedging or catching of two tensioning clamps is harmless as long as it does not lead to the formation of long chains which have to be separated from each other with large effort.

The rail fixation arrangement according to the invention comprises a tensioning clamp according to the invention as well as a sleeper screw having a screw head configured so that it rests upon the inner legs of the central loop. Here, the screw head and the tensioning clamp are dimensioned such that, in the pre-assembled state of the rail fixation having a screw head bearing upon the inner legs without tensioning force, the screw head does not extend above the maximum height of the nooses. Due to the presence of two nooses at each side of the central loop, the head of the sleeper screw is thus protected in the region of the central loop and cannot be damaged.

In the assembled position, the tensioning clamp rests on the upper side of the rail foot and at the sleeper by means of an angle guide plate situated in a recess of the upper side of the sleeper. This measure has the purpose to direct the transversal forces occurring in the region of the rail across an as large as possible area into the sleeper. But at the same time, the sleeper screw is again protected against excessive bending or shear stress.

BRIEF DESCRIPTION OF THE DRAWINGS

Further advantages and features of the elastic tensioning clamp according to the invention as well as a rail fixation arrangement to be advantageously used in connection with the tensioning clamp will become apparent from the following detailed description of a preferred embodiment illustrated in the following figures.

FIG. 6 shows a conventional rail fixation arrangement according to the illustration of FIG. 4 during insertion of a rail.

DETAILED DESCRIPTION

Figure 2:
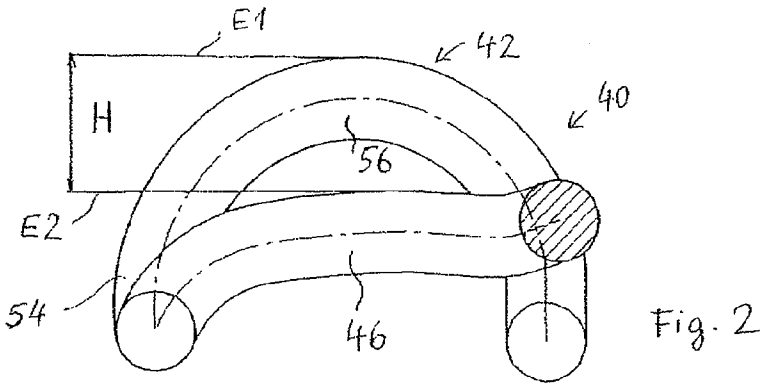
FIG. 2 shows an associated side view of a tensioning clamp according to the invention.

For ease of reference, in the following figures the same or similar components and parts of the tensioning clamp are indicated by the same reference numerals.

Figure 1:
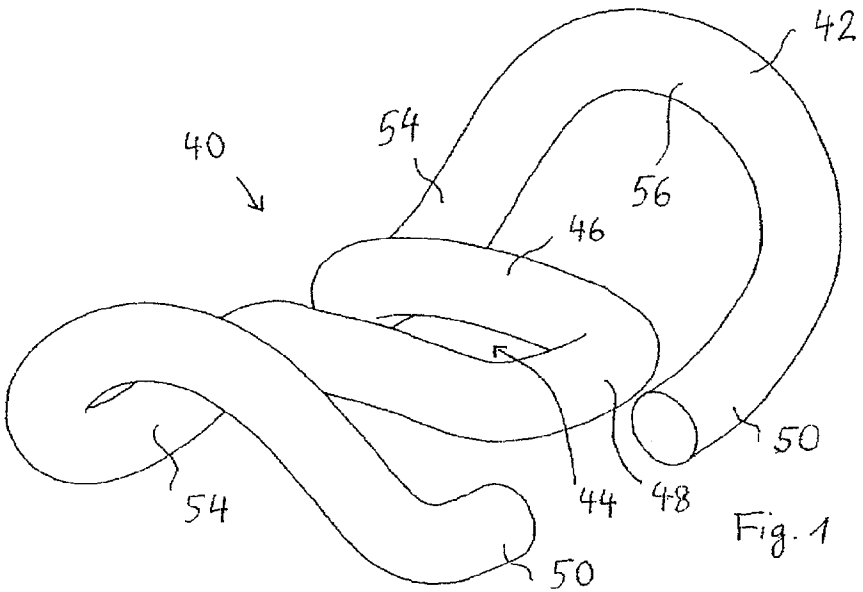
FIG. 1 shows a three-dimensional view of a tensioning clamp according to the invention.

The tensioning clamp 40 illustrated in FIG. 1 comprises two nooses (lugs) 42 connected to a central portion 44 that is substantially formed of two inner legs 46 connected by an arc-shaped central portion 48. As can be taken from FIG. 3, in particular, the inner legs run substantially parallel to each other. Between the inner legs 46, both in the pre-assembled state and in the assembled state, there is a sleeper screw not shown in FIGS. 1 to 3, wherein a displacement of the tensioning screw in the longitudinal direction of the inner legs and relative to the sleeper screw may be performed due to the parallel arrangement of the inner legs 46. In this way, the tensioning clamp can be brought from a pre-assembled position into an assembled position by means of a displacement motion. A displacement is necessary for this because the tensioning clamp may not extend into the region of the rail channel when in the pre-assembled position, while in the assembly position the free ends 50 of the tensioning clamp rest upon the rail foot. From FIG. 3, it can be seen that the inner legs 46 have a bend 57 toward each other in the transition region to the nooses 42, that is on the side facing away from the rail foot in the assembled position, through which bend a falling out of the tensioning clamp is avoided in the pre-assembled position as the sleeper screw cannot slip out from the region between the inner legs 46 in a direction towards the bend 57.

Further, bevels (flat portions) 52 may be provided on the inner legs, upon which the head of a sleeper screw (not shown) rests, possibly by interposition of a washer. Upon assembly, the sleeper screw is screwed into a plastic anchor fitting present in the sleeper in a known manner by means of a drive or a torque wrench engaging the head of the sleeper screw, until the desired tensioning force is established.

The nooses 42 connect at the side of the inner legs 46 opposite to the arc-shaped central portion 48, which nooses in turn consist of a rear support arc 54, outer legs 56 and the free ends 50 aligned with each other.

Figure 3:
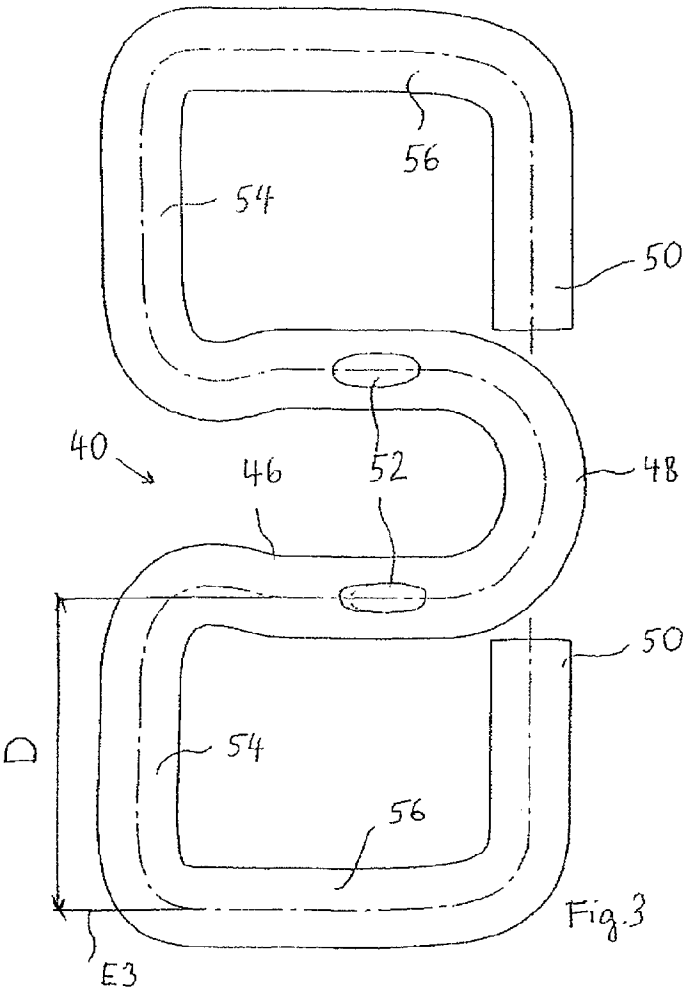
FIG. 3 shows a top view of a tensioning clamp according to the invention.

The outer legs 56 of nooses 42 are arc-shaped both in a vertical view and in a horizontal view, as can be seen in particular from a comparison of FIGS. 2 and 3. In FIG. 3, a top view of the tensioning clamp shown in FIG. 1 is illustrated. As can be seen from FIGS. 1 and 3, the outer leg 56 of nooses 42 has an arc-shaped configuration and is formed so that the nooses describe an arc if viewed from above, the secants of which run substantially parallel to the extension (course) of the inner legs 46. The arc-shaped extension is as far as possible uniform in order to transfer the force and bending moments uniformly towards the free ends 50 of the tensioning clamp.

As can be seen from FIG. 2, the maximum height H of the outer legs 56 in the untensioned state of the tensioning clamp is higher by an amount H of 24 mm as compared to the height of the inner legs. Preferably the height difference is in the range between 20 mm and 30 mm and is about 25 mm. The height difference is defined so that, in the untensioned state of the tensioning clamp, a horizontal plane indicated by $E_1$ in FIG. 2 is defined in the region of the highest elevation on the nooses 42 arranged symmetrically with respect to each other. Further, a plane $E_2$ is defined that is aligned horizontally in the same way and rests on those positions of the inner legs 46, on which the sleeper screw rests in the pre-assembled position. The distance between the two planes $E_1$ and $E_2$ constitutes the height difference H which is at least 20 mm. This height difference is chosen so as to be bigger in the pre-assembled state of FIG. 4*a* than the height of a head of a sleeper screw or, if using a washer, the sum of the heights of washer and head of a sleeper screw. By pre-setting the height difference, it is ensured that, as will be explained by means of FIG. 4*b*, the sleeper screw is not damaged when laying the rail during assembly. However, it is to be considered that, in the pre-assembled state, the inner legs of the tensioning clamp are tensioned downward by the sleeper screw and the tensioning clamp is already elastically deformed. In the pre-assembled state, the height H is increased by about 8 mm.

The tensioning clamp according to the invention is manufactured from spring steel and has a substantially circular cross section.

In order to prevent two identical tensioning clamps from getting caught, the free ends 50 of the tensioning clamp are arranged at a distance to the arc-shaped central portion 48 of the central part 44, which is smaller than the diameter of the spring steel from which the tensioning clamp is bent during one or more steps of cold deformation. This free distance cannot be taken from any of the illustrated figures as only a view parallel to the surface extension of the free distance between the free ends and the arc-shaped central portion will represent the correct dimensional relationships without distortion.

As can be seen from FIG. 3, the maximum horizontal distance D between the longitudinal axis of the inner leg and the tangential plane $E_3$ abutting the central axis of the outer leg in parallel to the inner leg is $D \geqq 50$ mm and preferably $D \geqq 60$ mm, so that a high torsion path can be ensured. This geometry is particularly advantageous if using the tensioning clamp at difficult track portions because high frequency oscillations occur for example in uphill regions due to the slipping of the wheels of rail cars, which cause a motion of the rail in a longitudinal direction despite properly fastened tensioning clamps. Providing a larger torsion portion increases the endurance limit of the rail connection as not only the torsional portion of the noose is increased but a relative increase of the bend radius in track direction takes place.

The tensioning clamp according to the invention has an endurance limit of more than 3 million load alternations, preferably more than 5 million load alternations with a tensioning force between 10 kN and 15 kN, and preferably with a tensioning force of about 12.5 kN. Thus, both by choosing a suitable spring steel, for an example 38 Si 7, and by designing the shape of the tensioning clamp, the desired high endurance limit with a high tensioning force can be ensured.

A high endurance limit in connection with the design of the shape of the tensioning clamp according to the invention allows a rail fixation arrangement having low assembly effort. First, the additional assembly effort after preassembly is avoided because a bending of the sleeper screws upon laying down the rail is avoided. Further, a reinstallation of a rail fixation after reaching its maximum lifetime is avoided due to the very high endurance limit. Finally, due to the design of the shape of the tensioning clamp having a very large arc D in the horizontal extension, an unintentional disengagement at difficult track portions is avoided, or at least the necessity of retightening or readjusting the rail fixation arrangement is reduced. Finally, by the design of the shape of the tensioning clamp having a free distance between the arc-shaped central portion of the central loop and the free ends of the tensioning clamp, which is smaller than the diameter of the spring steel in the region of the free ends of the tensioning clamp, a further simplification of the assembly is achieved as an undesired catching or concatenation of identical tensioning clamps in a loose, bulk-packaged container can at least be significantly reduced. All these measures thus cooperate in a synergetic manner in order to reduce the total assembly effort of the rail fixation arrangement by using the tensioning clamp according to the invention.

Figure 5:
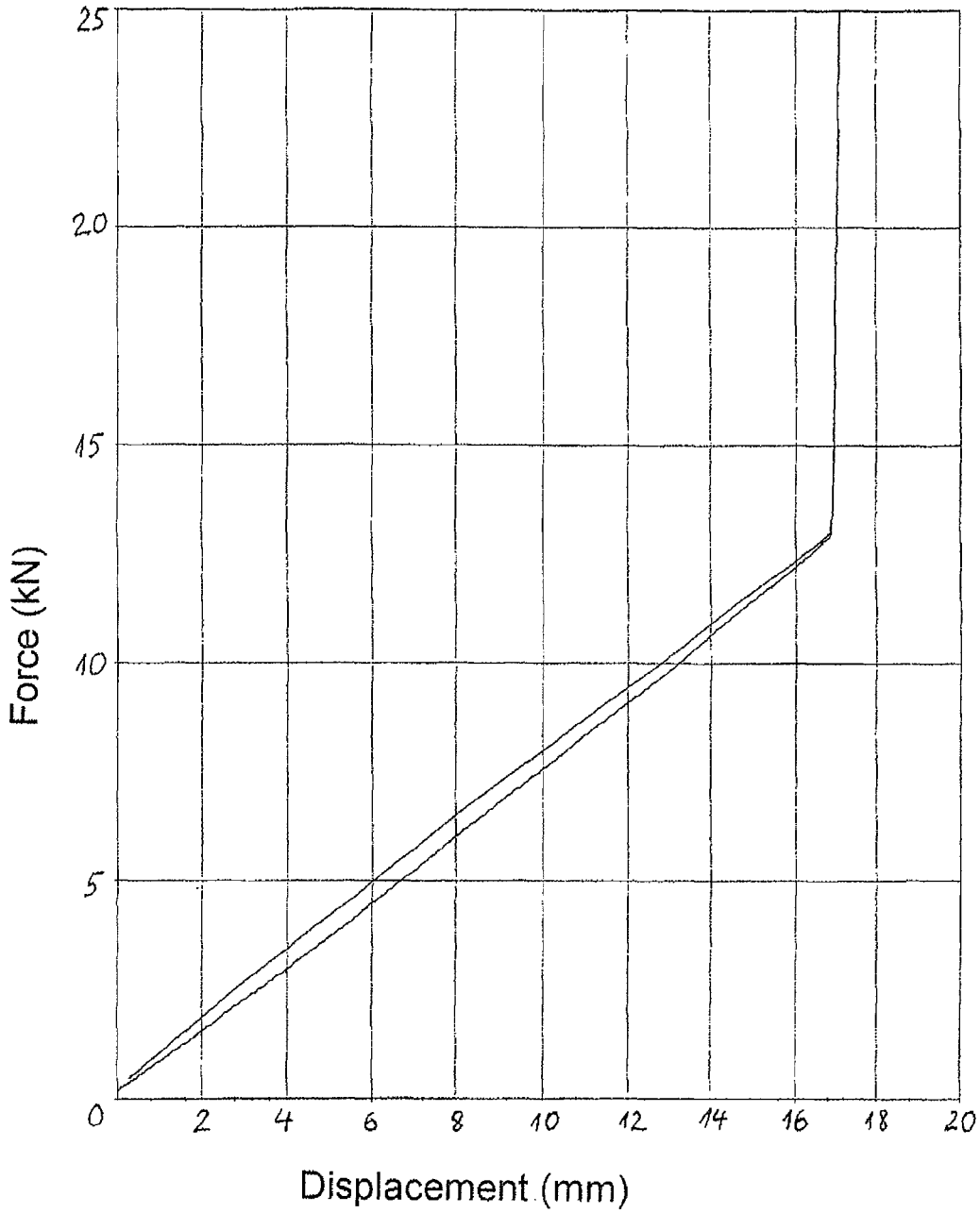
FIG. 5 shows a graph of force versus spring deflection of the tensioning clamp according to the invention.

FIG. 5 emphasizes the rigidity of the tensioning clamp according to the invention by the load-displacement diagram which was measured at the tenth application and removal of the load and is thus no longer influenced by the settling phenomena occurring during the first load events. It can be seen that with increasing loads, illustrated by the force plotted on the ordinate axis, up to slightly above a load of 13 kN, a spring travel of up to 16.3 mm and increasing proportionally to the load results, as can be read from the abscissa value associated with the ordinate value of 13 kN. Above this load of about 13 kN, the central loop of the tensioning clamp comes to rest on the rail foot so that the spring travel does not appreciably increase with further increasing loads. As can be seen from FIG. 5, the tensioning clamp according to the invention can receive a very high load of up to 13 kN with a long spring travel.

Figure 4A:
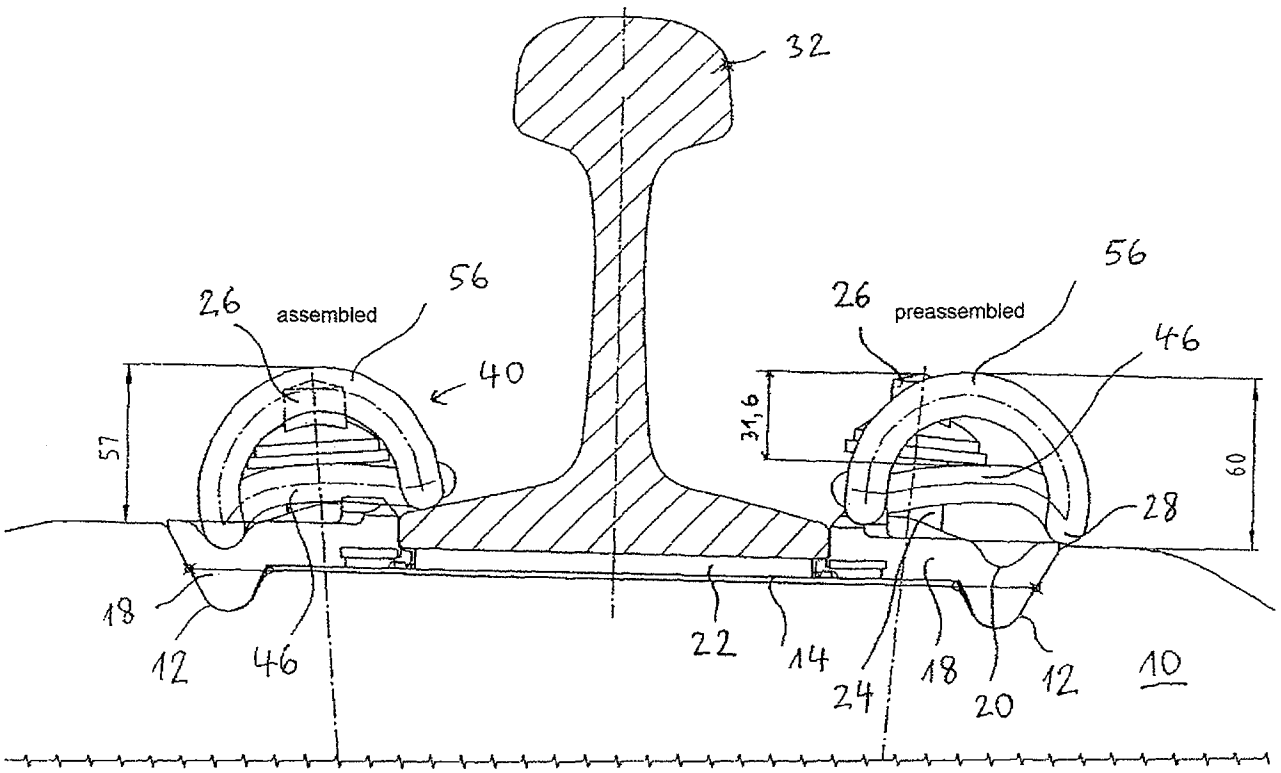
FIG. 4*a* shows an exemplary rail fixation utilising the tensioning clamp according to the invention, in a pre-assembled position and in an assembled position.
Figure 4B:
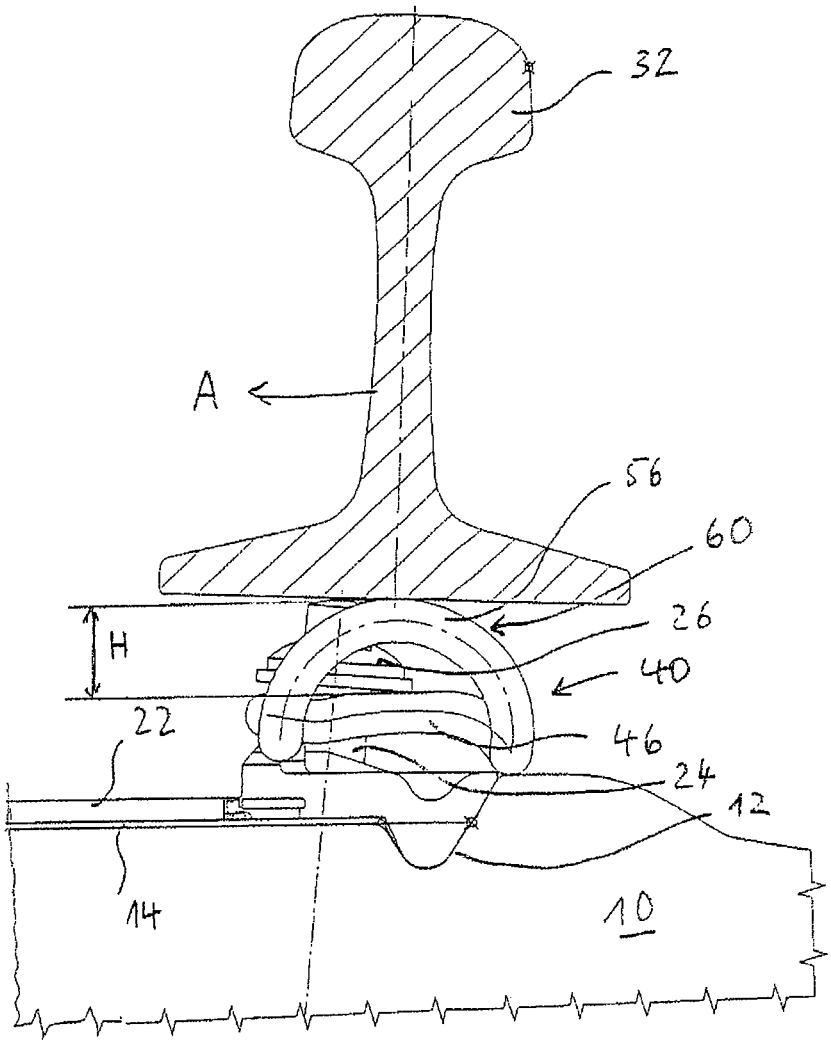
FIG. 4*b* shows a sectional view of a rail fixation arrangement according to the invention, in an assembled position during the insertion of a rail.

FIGS. 4*a* and 4*b* show the tensioning clamp according to the invention as part of a rail fixation. Here, FIG. 4*b* is intentionally modelled on the state of the art according to FIG. 6 in respect of the shape of all components, and underlines the advantage of the tensioning clamp 40 according to the invention. In FIGS. 4*a* and 4*b*, the section of a sleeper 10 having a recess 12 is shown, which at one side merges in the above-mentioned region of the rail channel 14 and at the opposite side comprises an abutment flank 16. In the recess 12 and in contact with the abutment flank 16, an angle guide plate 18 is used which is adapted in its form to the recess 12 and the abutment flank 16 of the sleeper 10. Moreover, the angle guide plate 18 comprises a groove-like recess 20 in which the tensioning clamp 40 with its rear support arcs 28 is inserted in the assembled position. In the region of the rail channel one or more elastic intermediate layers 22 may be inserted between the angle guide plates of the fixation points, according to need. The elastic intermediate layer on the one hand, serves the purpose to act as an isolator and, on the other hand, to establish the desired rail head cushioning in a targeted manner in accordance with the remaining components.

The tensioning clamp 40 is fixed to the sleeper 10 by a sleeper screw 24 and tensioned thereagainst. The sleeper screw comprises a shaft (merely outlined) provided with an outer thread and fastened within the sleeper 10 in an anchor-fitting not shown in FIGS. 4*a* and 4*b*. Moreover, the sleeper screw 24 has an enlarged head 26 which either rests on the elastic tensioning clamp which is untensioned, i.e. unloaded, in the pre-assembled position shown in FIG. 4*a*, or is screwed into the sleeper to the extent that it is arranged at least at a small distance to the tensioning clamp in the unloaded state.

As can be seen from the comparison of the height-indications of the tensioning clamp 40 above the upper side of the sleeper, the tensioning clamp in the pre-assembled position shown on the right hand side in FIG. 4*a* has a larger height above the sleeper than in the assembled position shown on the left hand side in FIG. 4*a*. This is because, on the one hand, the rear support arcs 28 of the tensioning clamp are not yet received in the groove-shaped recess 20 of the angle guide plate 18 in the pre-assembled position and, on the other hand, the inner legs 46 are elastically pressed downward by the elasticity of the sleeper screw in the assembled position. As can be seen from FIG. 4*a*, the head of the sleeper screw is dimensioned or adapted to the dimensions of the tensioning clamp so that the head 26 does not protrude upwardly above the plane defined by the upper termination of the tensioning clamp.

As is shown by means of an example in FIG. 4*b*, upon insertion into the rail channel 14, a rail 32 may be lifted not sufficiently high above the preassembled rail fixation arrangement so that the rail comes to bear upon the rail fixation arrangement. In contrast to the state of the art shown in FIG. 6, in the rail fixation arrangement according to the invention the tensioning clamp 40 is configured so that the outer legs 56 of the tensioning clamp 40 extend so high above the inner legs 46 that the weight of the rail no longer rests on the head 26 of the sleeper screw 24 and, thus, does not bend the sleeper screw. Here, the height H is to be provided such that upon laying down the long heavy rail the elastic deformations occurring in the region of the outer leg 56 are also taken into consideration.

At the same time, due to the arc-shaped extension in the vertical sectional view illustrated in FIGS. 4*a* and 4*b*, the outer leg 56 acts like a ramp supporting the lifting of a resting rail in the region 60 so that the rail may be introduced into the rail channel 14.

The invention claimed is:

1. Elastic tensioning clamp made of spring steel for rail fixation, comprising:

a central loop having two inner legs connected by an arc-shaped central portion; and nooses connected to the inner legs of the central loop and running toward free ends of the tensioning clamp;

characterized in that the nooses are configured to have, in an unloaded state, each a maximum height (H) of at least 20 mm above an upper surface of the central loop in the region of the two inner legs.

2. Elastic tensioning clamp according to claim 1, characterized in that maximum height (H) is no more than 42 mm.

3. Elastic tensioning clamp according to claim 1, characterized in that the inner legs run substantially parallel to each other.

4. Elastic tensioning clamp according to claim 1, characterized in that the inner legs have, at an upper side in an assembled position, a bevel in the region of resting contact of a sleeper screw fixing the tensioning clamp in the assembled position.

5. Elastic tensioning clamp according to claim 1, characterized in that the nooses are connected to the inner legs via a rear support arc and are formed so that the nooses have, in an assembled position, an arc-shaped course both in an horizontal direction and in a vertical direction.

6. Elastic tensioning clamp according to claim 5, characterized in that the rear support arc is formed so that a distance D between the inner leg and a parallel tangential plane at the outer leg is $D \geqq 50$ mm.

7. Elastic tensioning clamp of claim 6 wherein the parallel tangential plane of the outer leg is $D \geqq 60$ mm.

8. Elastic tensioning clamp according to claim 1, characterized in that the tensioning clamp has an endurance limit of more than 3 million load alternations, with a tensioning force between 10 kN and 15 kN.

9. Elastic tensioning clamp of claim 8 wherein the endurance limit of the tensioning clamp is more than 5 million load alternations.

10. Elastic tensioning clamp according to claim 1, characterized in that the nooses describe an arc in a top view, secants (S) of which are substantially parallel to an extension of the inner legs.

11. Elastic tensioning clamp according to claim 1, characterized in that a free distance between the arc-shaped central portion of the central loop and the free ends of the tensioning clamp is smaller than a diameter of the spring steel in the region of the free ends of the tensioning clamp.

12. Rail fixation arrangement comprising:

the tensioning clamp according to claim 1; and a sleeper screw having a screw head formed so as to rest on the inner legs of the central loop and;

wherein the screw head and the tensioning clamp are dimensioned so that the screw head does not extend above a maximum height of the tensioning clamp in a pre-assembled state of the rail fixation having the inner legs resting on the screw heads without tensioning force.

13. Rail fixation arrangement according to claim 12, characterized in that the tensioning clamp bears upon an upper side of a rail foot of a rail and on a sleeper in a recess in an upper side of the sleeper, in an assembled position.

14. Elastic tensioning clamp of claim 1 wherein the maximum height (H) of the nooses in the unloaded state is at least 24 mm.

* * * * *